US005823258A

United States Patent [19]

Goldner

[11] Patent Number: 5,823,258

[45] Date of Patent: Oct. 20, 1998

[54] CENTRALIZER APPARATUS

[76] Inventor: Herman Goldner, Lot 9, Mildura Road, Mount Helena, Western Australia, Australia

[21] Appl. No.: 717,947

[22] Filed: Sep. 23, 1996

[51] Int. Cl.[6] ..... E21B 33/038; E21B 33/04

[52] U.S. Cl. ..... 166/77.1; 166/68; 226/191; 226/194; 242/397.5

[58] Field of Search ..... 166/77.1, 77.2, 166/77.3, 68, 85.1; 226/191, 192, 194; 242/157 R, 397.5, 615.2

[56] References Cited

U.S. PATENT DOCUMENTS

| | | | |
|---|---|---|---|
| 1,189,611 | 7/1916 | Morse | 242/615.2 X |
| 1,517,027 | 11/1924 | Smith . | |
| 1,699,087 | 1/1929 | Woodmansce . | |
| 1,801,294 | 4/1931 | Sutton . | |
| 2,925,640 | 2/1960 | Morrow | 226/192 X |
| 3,005,413 | 10/1961 | Coberly | 166/68 X |
| 3,116,793 | 1/1964 | McStravick | 166/77.2 X |
| 3,791,564 | 2/1974 | Hugonin | 226/186 X |
| 3,907,048 | 9/1975 | Gray . | |
| 4,122,985 | 10/1978 | Nelson | 226/192 X |
| 4,372,622 | 2/1983 | Check . | |
| 4,770,550 | 9/1988 | Takahashi | 242/615.2 X |
| 4,913,230 | 4/1990 | Rivas et al. | 166/241.3 |
| 5,191,938 | 3/1993 | Sable et al. | 166/378 |

FOREIGN PATENT DOCUMENTS

| | | |
|---|---|---|
| 271839 | 3/1928 | United Kingdom . |
| 94/23174 | 10/1994 | WIPO . |
| 95/11368 | 4/1995 | WIPO . |

*Primary Examiner*—George A. Suchfield
*Attorney, Agent, or Firm*—Gipple & Hale; John S. Hale

[57] ABSTRACT

A centralizer apparatus (1) for centralizing a rod (100). The centralizer apparatus (1) has a guide roller (2) which contacts the rod (100) and a pressure adjustment member (5) to enable the contact pressure of the guide roller (1) against the rod (100) to be adjusted. Mounting plates (3*a*, 3*b*, 4*a*, 4*b*) mount the centralizer apparatus (1) so that it is fixable relative to the rod (100). The centralizer apparatus (1) enables the orientation of the guide roller (2) to be adjusted relative to the rod (100) about two orthogonal axes (25,26). The guide roller (2) is also locatable relative to the circumference and length of the rod (100) at selected locations.

20 Claims, 3 Drawing Sheets

1
102
F
R
A
10
15
5
100
2c
7
C
14b
26
9
17
12
14a
13
9a
16
11
18
9b
9
a
2
14
D
12
9a
8
2
11
9b
20
4a
2
P
E
23
101
22
4c
21
3a
22
23
B
23
21
22
23
23
3b
4b
25
3c
23
4c

CENTRALIZER APPARATUS

BACKGROUND OF THE INVENTION

The present invention relates to a centralizer apparatus for centralizing a rod.

1. Field of the Invention

Reciprocating rods are used in machinery for a range of purposes.

2. Description of the Prior Art

For example, a reciprocating rod (also referred to as a polished rod or lifting rod) is used with below ground well pumps. The reciprocating rod is connected to a pump at the bottom of the well, eg by sucker rods, and is reciprocated by a drive means at ground level such that the pump pumps well fluids to the surface.

In a further example, a reciprocating rod is used in a hydraulic ram in which it extends from and retracts into the hydraulic ram cylinder.

It is desirable to maintain such rods centralized in the machinery in which they are reciprocating.

In the case of a polished rod in a pump, the well bore in which the pump is located is often not perfectly perpendicular. This leads to the problem of the polished rod and the well head rubbing against one another and wearing at locations where the polished rod and well head engage, eg at the stuffing box of the well head.

In the case of a hydraulic ram, the ram may be disposed at various angles depending upon the application of use of the ram. The extension and retraction of the rod from and into the ram cylinder can cause wear of the rod and the cylinder at locations where the rod bears against the cylinder. Such wear increases in instances where the rod is heavy and long, as significant rubbing causing wear can occur between the rod and cylinder particularly when the rod continuously extends from and retracts into the cylinder.

Such wear reduces the operational life of parts prone to wear leading to replacement of parts with attendant operational downtime of equipment to enable the replacement of worn parts to be carried out, all of which are undesirable.

SUMMARY OF THE INVENTION

In accordance with a first aspect of the present invention there is provided a centralizer apparatus for centralizing a rod comprising at least one guide roller means to contact the rod, mounting means to mount the centralizer apparatus such that it is fixable relative to the rod, and pressure adjustment means to enable the contact pressure of the guide roller means against the rod to be adjusted.

Preferably, the orientation of the guide roller means relative to the rod is adjustable.

Preferably, the guide roller means is movable relative to the rod about an axis substantially transverse to the axis of the rod to enable the orientation of the guide roller means relative to the rod in a first orientational direction to be adjusted.

Preferably, the guide roller means is movable relative to the rod about an axis substantially parallel to the axis of the rod to enable the orientation of the guides roller means relative to the rod in a second orientational direction to be adjusted.

Preferably, the guide roller means is locatable at a selected location relative to the rod.

Preferably, the guide roller means is movable relative to the rod about the axis of the rod such that the guide roller means is locatable at a selected location relative to the circumference of the rod.

Preferably, the guide roller means is movable relative to the rod in a direction substantially parallel to the axis of the rod such that the guide roller means is, locatable at a selected location along the length of the rod.

Preferably, the guide roller means is rotatably supported by support means and the support means is movable to move the guide roller means toward and away from the rod, and the pressure adjustment means is operable to exert a force on the support means and adjust the pressure of the guide roller means against the rod.

Preferably, the pressure adjustment means comprises a first rotatable member rotatable in a first direction to increase the force exerted on said support means and rotatable in a second direction to decrease the force exerted on said support means.

Preferably, two guide roller means are provided and are disposed on diametrically opposed sides of said rod.

The present invention will now be described, by way of example, with reference to the accompanying drawings, in which:

DESCRIPTION OF THE PREFERRED EMBODIMENT(S)

Figure 1:
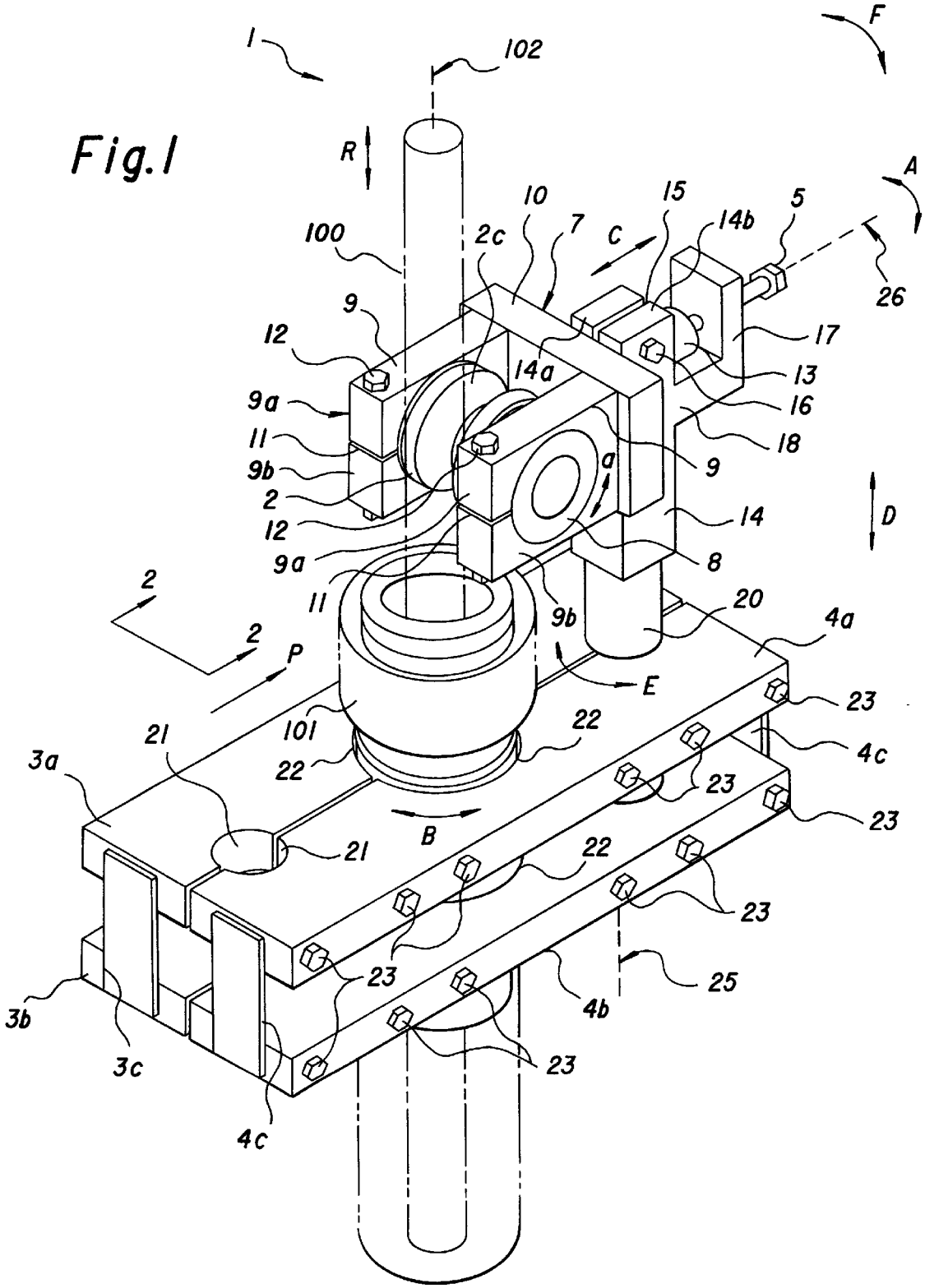
FIG. 1 is a perspective view of an embodiment of a centralizer apparatus for centralizing a rod in accordance with the present invention.

In FIG. 1, there is shown a centralizer apparatus 1 for centralizing a rod 100 comprising a guide roller 2 to contact the rod 100, mounting plates 3*a*, 3*b*, 4*a* and 4*b* to mount the centralizer apparatus 1 such that it is fixable relative to the rod 100, and a pressure adjustment screw 5 to enable the contact pressure of the guide roller 2 against the rod 100 to be adjusted.

The guide roller 2 is rotatably supported by a support member 7 via roller bearing assemblies 8. The support member 7 is in the form of a yolk having a pair of arms 9 extending from a back plate 10. Respective roller bearing assemblies 8 are provided in the arms 9. The arms 9 have openings therein which accommodate the roller bearing assemblies 8.

The arms 9 have respective slits 11 therein at their distal parts. The slits 11 divide the distal parts (ie the parts between the ends of the arms 9 and the openings accommodating the roller bearing assemblies 8) of the arms 9 into portions 9*a* and 9*b* which are spaced apart by the slits 11. The slits 11 extend from the ends of the arms 9 to the openings which accommodate the roller bearing assemblies 8. Respective bolts 12 pass through the portions 9*a* and 9*b* of the arms 9, at their distal parts, transverse to the slits 11 and through the slit 11.

The bolts 12 can be tightened which results in the portions 9*a* and 9*b* of each arm 9 moving toward one another thereby narrowing the slits 11. This movement of the portions 9*a* and 9*b* acts to securely clamp the roller bearing assemblies 8 in the arms 9. When the bolts 12 are loosened, the roller bearing assemblies 8 and guide roller 2 can be removed from the support member 7.

The support member 7 has a shank 13 which projects from the back plate 10 on the side opposed to that from which the arms 9 extend.

The shank 13 is accommodated in an opening (obscured) in a support post 14. The support post 14 is provided with a slit 15 which extends from its end to the opening which accommodates the shank 13. The slit 15 divides the end region of the support post 14 (ie the region between the end of the support post 14 and the opening accommodating the shank 13) into two portions 14*a* and 14*b*.

A bolt 16 passes through the portions 14*a* and 14*b* of the support post 14 and the slit 15, in a direction transverse to the slit 15.

The bolt 16 can be tightened which results in the portions 14*a* and 14*b* of the support member 14 moving toward one another thereby narrowing the slit 15. This movement of the portions 14*a* and 14*b* acts to securely clamp the shank 13 in the support post 14.

The pressure adjustment screw 5 engages with a screw threaded hole in a support plate 17 and can be turned in the direction of arrows A (as shown in FIG. 1) and bear against the shank 13. The support plate 17 is connected with the support post 14 by a connection plate 18 offset from the support post 14.

The lower portion 20 of the support post 14 is accommodated between the mounting plates 3*a*, 3*b*, 4*a* and 4*b*. Each mounting plate 3*a*, 3*b*, 4*a* and 4*b* is provided with a pair of recesses 21. Each recess 21 of the mounting plates 3*a* and 3*b* is opposed to a recess 21 of an adjacent mounting plate 4*a* and 4*b*, respectively. The lower portion 20 is accommodated by a pair of opposed recesses 21 of adjacent mounting plates 3*a* and 4*a* and adjacent mounting plates 3*b* and 4*b*.

As can be seen in FIG. 1, two sets of recesses 21 are provided and enable the lower portion 20 to be supported at either of two locations, on diametrically opposite sides of the rod 100, between the mounting plates 3*a*, 3*b*, 4*a* and 4*b*.

Alternatively, the two sets of recesses 21 may support the lower portions 20 of two support posts 14, with each support port 14 supporting a support member 7 with a guide roller 2 mounted therein.

The mounting plates 3*a* and 3*b* and the mounting plates 4*a* and 4*b* are connected together by connection strips 3*c* and 4*c*, respectively. This allows easier handling of the mounting plates 3*a*, 3*b*, 4*a* and 4*b* during installation and removal of the centralizer apparatus 1.

Each mounting plate 3*a*, 3*b*, 4*a* and 4*b* is provided with a further recess 22. The recesses 22 accommodate a part of a well head 101, which supports the rod 100, that is fixed relative to the rod 100. Each recess 22 of the mounting plates 3*a* and 3*b* is opposed to a recess 22 of an adjacent mounting plate 4*a* and 4*b*, respectively.

The well head 101 is accommodated by a pair of opposed recesses 22 of adjacent mounting plates 3*a* and 4*a* and adjacent mounting plates 3*b* and 4*b*.

Bolts 23 pass through adjacent mounting plates 3*a* and 4*a* and adjacent mounting plates 3*b* and 4*b* to fixedly clamp the mounting plates 3*a*, 3*b*, 4*a* and 4*b* around the well head 101. In this way, the mounting plates 3*a*, 3*b*, 4*a* and 4*b* mount the centralizer apparatus 1 such that it is fixable relative to the rod 100. The centralizer apparatus 1 can be removed from the well head 101 by undoing the bolts 23 to detach the mounting plates 3*a*, 3*b*, 4*a* and 4*b* from the well head 101.

In the preceding description, the centralizer apparatus 1 was described as being fixably mounted relative to the rod 100 via the mounting plates 3*a*, 3*b*, 4*a* and 4*b* being clamped around the well head 101. However, the centralizer apparatus 1 may be mounted to any suitable support such that it is fixable relative to the rod 100. Accordingly, alternative means other than the recesses 22 may be used to mount the centralizer apparatus 1 to a support fixed relative to the rod 100.

The manner of use and operation of the centralizer apparatus 1 will now be described.

Figure 3:
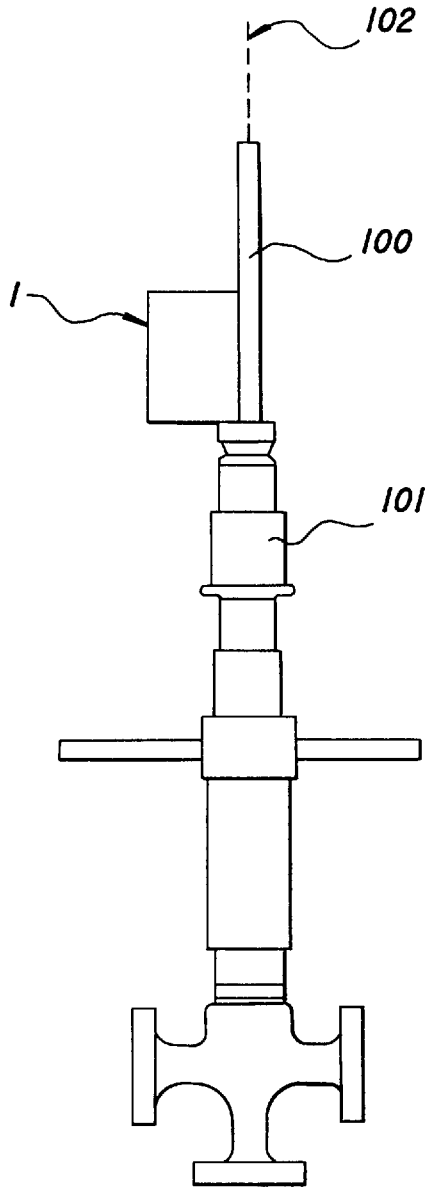
FIG. 3 is a schematic side elevation view of the centralizer apparatus shown in FIG. 1 in position on a well head.

The manner of use and operation of the centralizer apparatus 1 in the following description will be with reference to the centralizer apparatus 1 being mounted on a well head 101 as shown schematically in FIG. 3.

When the centralizer apparatus 1 is to be mounted to a well head 101 to centralize a rod 100, the direction of the pressure being exerted on the rod 100 by the well head 101 is first noted. This can be readily done since the pressure exerted on the rod 100 causes a score line to appear on the rod 100 due to the metal contact between the rod 100 and the well head 101 in the case of the rod 100 not being centralized.

The centralizer apparatus 1 is mounted to the well head 101 by clamping the mounting plates 3*a*, 3*b*, 4*a* and 4*b* around the well head 101 with the well head 101 being received between the recesses 22. The bolts 23 are then tightened such that the mounting plates 3*a*, 3*b*, 4*a* and 4*b* are loosely clamped around the well head 101 such that the centralizer apparatus 1 is loosely mounted in place.

Figure 2:
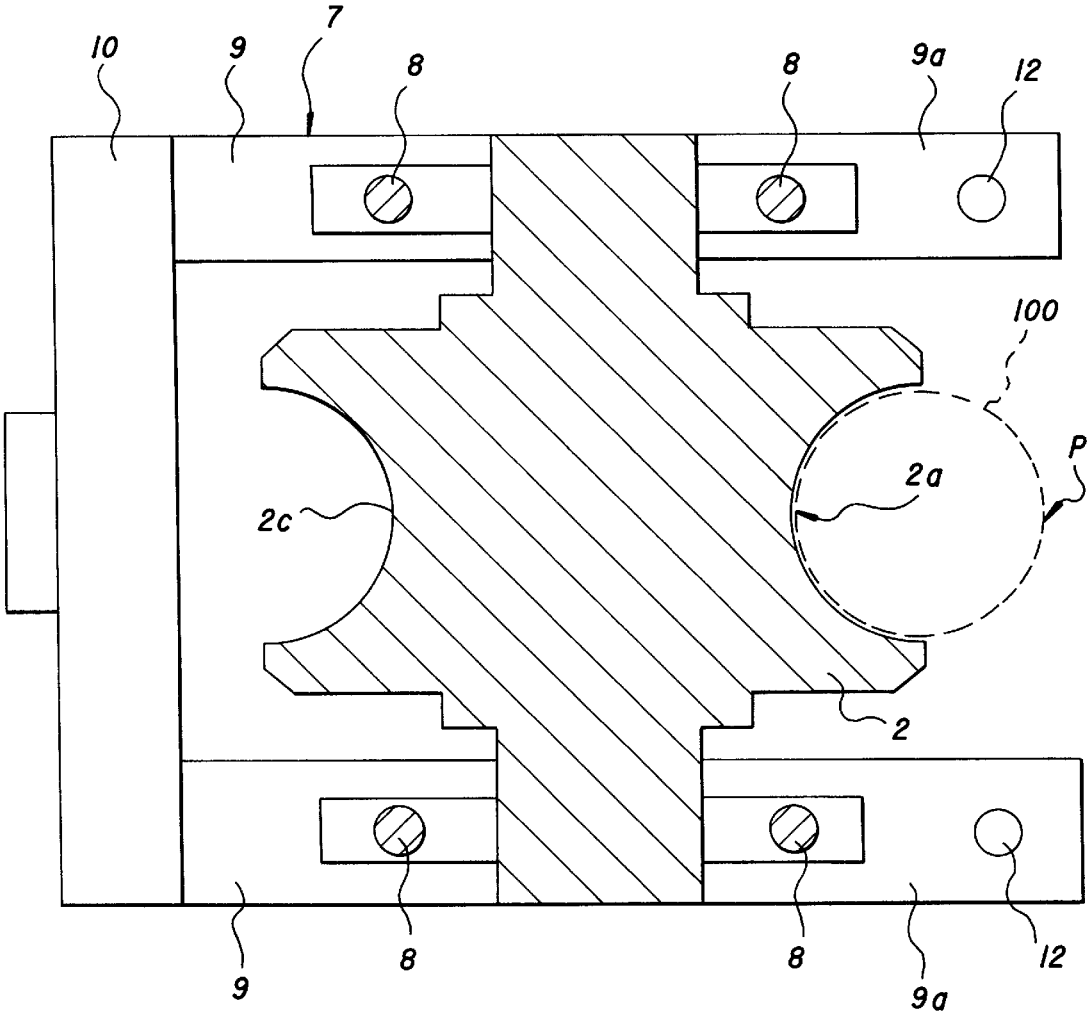
FIG. 2 is a horizontal cross sectional view through the guide roller and guide roller support of the centralizer apparatus along the line 2—2 shown in FIG. 1.

Once the direction of the pressure being exerted on a rod 100 by the well head 101 has been determined, the mounting plates 3*a*, 3*b*, 4*a* and 4*b* can be rotated in one of the directions shown by arrows B such that the direction of the pressure exerted by the well head 101 on the rod 100 is opposed to the middle of the guide roller 2. In FIG. 1, the direction of the pressure exerted by the well head 101 on the rod 100 is shown by the arrow P. The old rod 100 can be removed from the well head 101 and a new rod 100 inserted and held central. The centralizer device 1 is then mounted on the well head 101 with the mid point 2*a* of the guide roller 2 being opposed to the direction of pressure P as shown in FIG. 2.

The rod 100 is held central and the support member 7 is moved toward the rod 100 such that the guide roller 2 is in contact with the rod 100. This can be done since the shank 13 is able to slide in the support post 14, with the bolt 16 loosened, in the directions shown by arrows C in FIG. 1. The pressure adjustment screw 5 is then turned in the appropriate direction, of arrows A, such that it bears against the end of the shank 13. In this way, the pressure adjustment screw 5 exerts a force on the support member 7 and the guide roller 2 presses against the rod 100. The pressure adjustment screw 5 is then turned an additional amount, eg one turn, to ensure that the guide roller 2 is in snug contact with the rod 100. Thus, the contact pressure of the guide roller 2 against the rod 100 can be adjusted. The bolt 16 is then tightened to retain the support member 7 in fixed position, and such that the guide roller 2 is able to contact the rod 100 with a selected pressure. Similarly, the bolts 23 are tightened to fixably mount the centralizer apparatus 1 to the well head 101.

Tightening of the bolts 23 will also fix the lower portion 20 of the support post 14 in position. This will prevent movement of the support post 14 in the directions of arrows D and E shown in FIG. 1.

The centralizer apparatus 1 enables the orientation of the guide roller 2 relative to the rod 100 to be adjusted. This enables the guide roller 2 to be placed in snug contact with the rod 100 to maintain the rod 100 in a centralized condition, prior to the bolts 16 and 23 being tightened.

Accordingly, the guide roller 2 is movable, relative to the rod 100, about an axis 25 which is substantially parallel to the axis 102 of the rod 100. This is done by rotating the lower portion 20 of the post 14 in one of the directions shown by arrows E in FIG. 1. Thus, the axis 25 is the axis of the support port 14. This movement enables the orientation of the guide roller 2 relative to the rod 100 in one direction to be adjusted. It can be described as a lateral movement of the guide roller 2 relative to the rod 100. When the bolts 23 near the ends of the mounting plates 3*a*, 3*b*, 4*a* and 4*b* at which the support post 14 is located are tightened, the support post 14 and the guide roller 2 are locked, in a selected position, from movement about the axis 25.

The guide roller 2 is movable, relative to the rod 100, about an axis 26 that is substantially transverse to the axis 102 of the rod 100. This is achieved since the shank 13, which is connected to the support member 7, can rotate about axis 26 in either of the directions shown by arrows F. This effectively rotates the guide roller 2 about axis 26. When the bolt 16 is tightened, the shank 13 is firmly held and the support member 7 and the guide roller 2 are locked, in a selected position, from rotation about axis 26. This movement enables the orientation of the guide roller 2 relative to the rod 100 in another direction to be adjusted.

The axes 25 and 26 are substantially orthogonal.

In addition, the ability of the shank 13 to slide in the directions of arrows C enables the guide roller 2 to be brought into initial contact with rod 100 prior to the pressure adjustment screw 5 being operated to adjust the contact pressure of the guide roller 2 against the rod 100. Again, tightening of the bolt 16 will firmly hold the shank 13 such that the support member 7 is locked from movement in the directions of arrows C.

The guide roller 2 is also movable, relative to the rod 100 in a direction substantially parallel to the axis 102 of the rod 100. This is achieved since the support post 14 is movable in the directions shown by arrows D. This can be done by loosening the bolts 23 near the support post 14 to slide the support post 14 (in the directions of arrows D) in the mounting plates 3*a*, 3*b*, 4*a* and 4*b*. This enables the guide roller 2 to be located at a selected location along the length of the rod 100. This adjustment is conveniently carried out at the time that the centralizer apparatus is mounted in place.

The guide roller 2 is also movable relative to the rod 100, about the axis 102 of the rod 100. This can be done by loosening the bolts 23 and moving the mounting plates 3*a*, 3*b*, 4*a* and 4*b* in either of the directions shown by arrows B. In this way, the guide roller 2 will also move relative to the rod 100 about the axis 102 of the rod 100. This enables the guide roller 2 to be located at a selected location relative to the circumference of the rod 100.

This adjustment is generally carried out at the time that the centralizer apparatus 1 is mounted in place. However, it also enables the centralizer apparatus 1 to be relocated at any time by slightly loosening the bolts 23 and turning the mounting plates 3*a*, 3*b*, 4*a* and 4*b* in either of the directions of arrows B. When the guide roller 2 has been relocated to the desired location relative to the circumference of the rod 100, the bolts 23 are again retightened.

The guide roller 2 has a surface 2*c* which is of concave shape. The surface 2*c* is in contact with the rod 100 around substantially half the circumference of the rod 100 as can be best seen in FIG. 2.

In use, the rod 100 reciprocates in the directions shown by arrows R in FIG. 1. This reciprocatory action of the rod 100 causes the guide roller 2 to rotate back and forth in the directions of arrows G shown in FIG. 1. Thus, the ability of the guide roller 2 to rotate in the directions of the arrows G in means that the reciprocatory action of the rod 100 is not impeded by the centralizer apparatus 1.

If the bearing assemblies 8 become worn, they may be removed, along with the guide roller 2 as previously described, and replaced.

The guide roller 2 would not normally need to be replaced, though if necessary, it can also be removed and replaced as previously described.

Preferably, the guide roller 2 is made of mild steel.

It is also possible that pressure is exerted on the rod 100 by the well head 101 in two diametrically opposed directions. Where a rod 100 has been reciprocating in such a situation, it will have two diametrically opposed score lines.

In such a situation, it is preferable that two diametrically opposed guide rollers 2 are provided. The second guide roller 2 (not shown) is also rotatably mounted in its own support member 7 which is in turn supported by its support post 14. This second support post 14 is accommodated in the (vacant) recesses 21 (as shown in FIG. 1) on the opposite side of the rod 100.

The second guide roller 2 is adjusted in a similar manner as previously hereinbefore described.

Whilst the preceding embodiment has been described with reference to the centralizer apparatus 1 being used with a rod 100 in the form of a polished rod of a well pump, it is to be understood that the centralizer apparatus 1 of the present invention may be used in other applications where a reciprocating rod must be held in a centralized condition. In such other applications, the mounting means for the centralizer apparatus 1 may need to be modified to enable the centralizer apparatus 1 to be mounted such that it is fixable relative to the reciprocating rod to be centralized.

Modifications and variations such as would be apparent to a skilled addressee are deemed to be within the scope of the present invention.

I claim:

1. A centralizer apparatus for centralizing a rod comprising at least one guide roller means to contact said rod, mounting means to mount said centralizer apparatus such that it is fixable relative to said rod, and pressure adjustment means to enable the contact pressure of said guide roller means against said rod to be adjusted.

2. A centralizer apparatus according to claim 1, wherein the orientation of said guide roller means relative to said rod is adjustable.

3. A centralizer apparatus according to claim 2, wherein said guide roller means, is able to move relative to said rod about a first axis substantially transverse to the axis of the rod to enable the orientation of said guide roller means relative to the rod in a first orientational direction to be adjusted.

4. A centralizer apparatus according to claim 3, wherein said guide roller means is rotatably supported by support means and said support means is movable about said first axis such that said guide roller means is thereby able to move relative to said rod about said first axis.

5. A centralizer apparatus according to claim 3, wherein said guide roller means is rotatably supported by support means and said support means is movable about said first axis such that said guide roller means is thereby able to move relative to said rod about a first axis and first locking means is provided to lock said support means in a selected position such that said guide roller means is also thereby locked in a selected position of said first orientational direction.

6. A centralizer apparatus according to claim 2, wherein said guide roller means is able to move relative to said rod about a second axis that is substantially parallel to the axis of said rod to enable the orientation of said guide roller means relative to the rod in a second orientational direction to be adjusted.

7. A centralizer apparatus according to claim 6, wherein said guide roller means is rotatably supported by support means and said support means is supported by post means, said post means being movable about said second axis such that said guide roller means is thereby able to move relative to said rod about said second axis.

8. A centralizer apparatus according to claim 6 wherein said guide roller means is rotatably supported by support means and said support means is supported by post means, said post means being movable about said second axis such that said guide roller means is thereby able to move relative to said rod about said axis and locking means is provided to lock said post means in a selected position such that said guide roller means is also thereby locked in a selected position of said second orientational direction.

9. A centralizer apparatus according to claim 1, wherein said guide roller means is rotatably supported by support means and said support means is movable to move said guide roller means toward and away from said rod, said pressure adjustment means operable to exert a force on said support means such that said contact pressure of said guide roller means against said rod is adjustable.

10. A centralizer apparatus according to claim 9, wherein locking means is provided to lock said support means from movement such that said guide roller means is able to contact said rod with a selected pressure.

11. A centralizer apparatus according to claim 9, wherein said pressure adjustment means comprises a first rotatable member rotatable to exert said force on said support means such that said guide roller means presses against said rod, said rotatable member provided with a screw thread arranged to engage with a screw threaded hole in a support plate such that the pressure of said guide roller means against said rod is adjustable by turning said rotatable member.

12. A centralizer apparatus according to claim 11, wherein said support means is provided with a projecting member against which said first rotatable member bears.

13. A centralizer apparatus according to claim 1, wherein roller bearing assemblies are provided such that said guide roller means is rotatably supported.

14. A centralizer apparatus according to claim 1, wherein said guide roller means has a surface which is shaped such that it is in contact with said rod around substantially half the circumference of said rod.

15. A centralizer apparatus according to claim 1, wherein guide roller means is locatable at a selected location relative to said rod.

16. A centralizer apparatus according to claim 15, wherein said guide roller means is movable relative to said rod around the axis of the rod such that said guide roller means is locatable at a selected location relative to the circumference of said rod.

17. A centralizer apparatus according to claim 15, wherein said guide roller means is movable relative to said rod in a direction substantially parallel to the axis of said rod such that said guide roller means is locatable at a selected location along the length of said rod.

18. A centralizer apparatus according to claim 16, wherein a first and a second locking means are provided to lock said mounting means at a selected location to thereby lock said guide roller means at said selected location relative to said circumference of said rod.

19. A centralizer apparatus according to claim 17, wherein said guide roller means is rotatably supported by support means, said support means being supported by post means which is supported by said mounting means, and locking means is provided to lock said post means to thereby lock said guide roller means at said selected location along the length of said rod.

20. A centralizer apparatus according to claim 1, wherein two said guide roller means are provided and are disposed on diametrically opposed sides of said rod.

* * * * *